United States Patent [19]

Herrmann

[11] Patent Number: 4,945,978

[45] Date of Patent: Aug. 7, 1990

[54] HEAT EXCHANGER SYSTEM

[75] Inventor: Helmut A. Herrmann, Kassel, Fed. Rep. of Germany

[73] Assignee: Schmidt'sche Heissdampf GmbH, Kassel-Bettenhausen, Fed. Rep. of Germany

[21] Appl. No.: 254,970

[22] Filed: Oct. 7, 1988

[30] Foreign Application Priority Data

Oct. 10, 1987 [DE] Fed. Rep. of Germany ..... 3734216

[51] Int. Cl.[5] ..... C10G 9/18; F28F 7/00; F28F 13/00

[52] U.S. Cl. ..... 165/47; 165/100; 165/139; 208/48 Q; 196/136; 196/138; 196/140; 122/6 A; 422/207

[58] Field of Search ..... 165/169, 142, 139, 155, 165/100, 102, 47; 208/48 Q; 196/136, 138, 140; 422/207; 122/6 A, 7 R

[56] References Cited

U.S. PATENT DOCUMENTS 4,294,312 10/1981 Kehrer et al. ..... 165/142
4,395,268 7/1983 Zabelka ..... 122/6 A
4,481,014 11/1984 Dorling ..... 122/6 A
4,493,291 1/1985 Zabelka ..... 122/7 R
4,513,694 4/1985 Wiemer ..... 122/6 A
4,520,760 6/1985 Covell ..... 122/6 A
4,807,698 2/1989 Kohnen et al. ..... 122/6 A

FOREIGN PATENT DOCUMENTS 639268 5/1962 Italy ..... 165/155

*Primary Examiner*—John Ford
*Attorney, Agent, or Firm*—Chilton, Alix & Van Kirk

[57] ABSTRACT

In order to create an economic two-stage heat exchanger system which is capable of cooling cracked gas from short-term splitting furnaces, which is capable of flexible operation utilizing changeable charging stock, the two stages of the heat exchanger are integrated in one device, in order to avoid the necessity of delivering the cracked gas to a second stage via long, hot pipelines. In addition, the system has the capability of switching the heat exchanger plant over to a single-stage operation.

4 Claims, 3 Drawing Sheets

HEAT EXCHANGER SYSTEM

BACKGROUND OF THE INVENTION

1. Field of the Invention

The invention is concerned with heat exchangers for hot flowing gases, especially gases resulting from the thermic splitting or cracking of gaseous and liquid hydrocarbons, and particularly with heat exchangers which may be connected in parallel, between a splitting furnace and a collector wherein oil may subsequently be injected into the gases. More particularly, this invention relates to heat exchangers having a plurality of individual heat exchanger devices, each individual heat exchanger having a pipe-shaped passageway for hot gas, each passageway being disposed within a cooling jacket along a portion of its length, and wherein each heat exchanger device is comprised of concentric pipes which are connected with one another and are impermeable to gas.

2. Description of the Prior Art

Heat exchangers of the type to which the invention relates are used in the cooling of process gases, especially gases resulting from the thermic splitting of gaseous and liquid hydrocarbons. Such heat exchangers are designed as single pipe apparatus which respectively attach to individual furnace splitting pipe exits and, at their inlets, have a cross-section which corresponds to that of the exits of the splitting furnace. In splitting furnaces which employ single-stage cracked gas cooling, in designing the heat exchanger, the band width of the raw materials to be used (gas to gasoil) must be taken into consideration. As a rule, the cracked gas exit temperature from the heat exchanger is chosen such that, in the clean condition of the apparatus, an energy recuperation which is still economical is attained when using light charging stock. When heavy stock is employed, the build-up of deposits on the cooling surfaces of the heat exchanger, i.e., coking, is still acceptable with such a chosen heat exchanger exhaust gas temperature. In general, the temperature range of the cracked gas downstream of the heat exchanger is limited to 420°–550° C. with a clean heating surface. An oil injector will typically be located downstream of the heat exchanger, the heat exchanger generally being a single-stage device, and the injector will produce a further cooling of the cracked gas.

The heat exchanger cooling surfaces, in time, become very dirty as a result of the build-up of deposits, i.e., due to coking, with the use of heavy stock and a gas exit temperature of 650° C. may be reached downstream of the heat exchanger. It is, accordingly, necessary to periodically de-coke the heat exchanger.

In splitting furnaces which employ two-stage cracked gas cooling, the heat exchanger system has customarily comprised of a large number of single-stage exchangers, which are connected to individual furnace exits. The single-stage heat exchangers discharge into a collector at a temperature of about 550°–650° C. When charging with light stock, i.e., gas or gasoline, an additional cooling of the cracked gases is accomplished in a further heat exchanger which, as a rule, is a large volume single apparatus for each furnace unit.

In the case of such furnaces wherein two-stage cooling is provided and heavy stock is used, i.e., gasoil hydrated residue, the cracked gas is taken directly out of the collector downstream of the first heat exchanger stage and is subjected to oil-injection. Thus, when heavy stock is used the additional heat exchanger is not employed.

The disadvantage of single-stage cooling as described immediately above is that the splitting process is limited to use of a relatively narrow range of feed stock if heavy coking is to be avoided. On the other hand, if one compromises here, then with light stock the energy gain is less than is technically possible. If necessary, a limitation of the gas travel time through the cooling system can ensue with coking during heavy stock charging. The advantages of single-stage heat exchangers are that they are relatively uncomplicated and reasonably priced, do not require hot connecting pipes between two serially connected heat exchanger stages and are characterized by an uncomplicated method of construction.

Previously available heat exchanger systems employing two-stage heat exchanger devices have been characterized by very high cost, because of the division of the first and second heat exchanger stages into two separate systems, which division demands a very elaborate hot interconnection, i.e., pipes which operate at a temperature in the range of 650°–680° C. In addition, the pressure losses of the entire system are high because of the relatively long pipes. Such pressure losses, in turn, result in the loss of splitting in the splitting furnace. An important advantage of two-stage heat exchanger systems is the possibility of flexibility since the operation can be adapted to suit the charging stock, i.e., only single-stage heat exchanger may be employed for heavy and two-stage heat exchangers may be employed for light stock.

SUMMARY OF THE INVENTION

The primary object of the invention is to provide an economical heat exchanger system, which is suitable for use in the cooling of cracked gas from short-term splitting furnaces which is designed for flexible operation utilizing changable charging stock.

The above-discussed object is obtained by providing a novel and improved heat exchanger wherein:

(a) the cooling jacket of a two-stage heat exchanger is, in part, defined by an array of pipes which are fluidically connected in parallel over most of its length of the heat exchanger. The array of pipes in part define first and second stage hot-gas passageways which is fluidically connected to the second stage of the heat exchanger through openings in the upper portion of the pipe array, (b) in the regions immediately adjacent both ends of the cooling jacket, the hot gas passageways of the heat exchanger, the passageways defining counter-flowing gas paths, are formed by abutting gas-impermeable pipes of equal diameter, and (c) the cooling jacket has an exit for hot-gas which is connected with a collector.

A heat exchanger system in accordance with the present invention has plural heat exchangers and:

(d) the collector to which the individual heat exchanger devices is connected is in turn coupled to a further collector by means of a pipe, (e) the pipeline by which hot gases are supplied to the heat exchanger system and cooling gases are discharged from the heat exchanger system is equipped with two control valves, each control valve being associated with an exit for the cooled gas, and (f) the exits are equipped with oil-injectors.

The present invention has the advantage, over the current state of technology, that the two-stage heat exchanger system can be utilized for both heavy as well as light charging stock (hydrocarbons) without the necessity of conducting cracked gas through long hot pipelines into a second, separate stage.

BRIEF DESCRIPTION OF THE DRAWING

The invention is detailed further in the descriptions and the drawings.

The drawings illustrate the following.

DESCRIPTION OF THE DISCLOSED EMBODIMENTS

Figure 2:
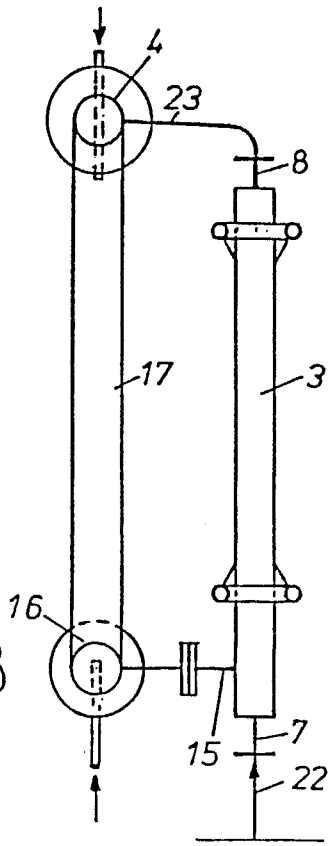
Figure 1:
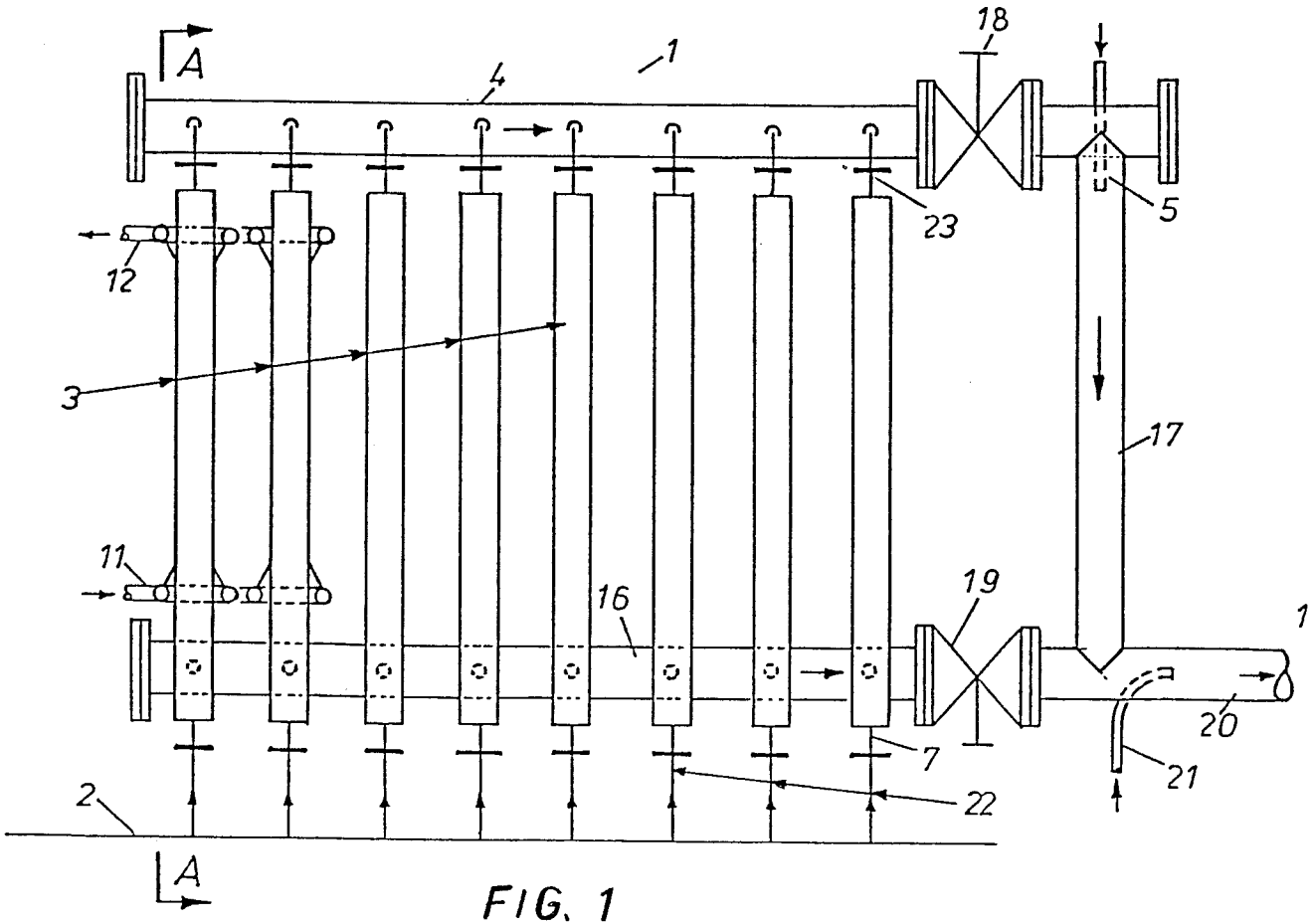
FIG. 1—Schematic representation of a cracked gas plant with subsequent integrated two-stage heat exchanger system in accordance with the present invention FIG. 2—Cross-sectional view taken along line A—A in FIG. 1.
Figure 3:
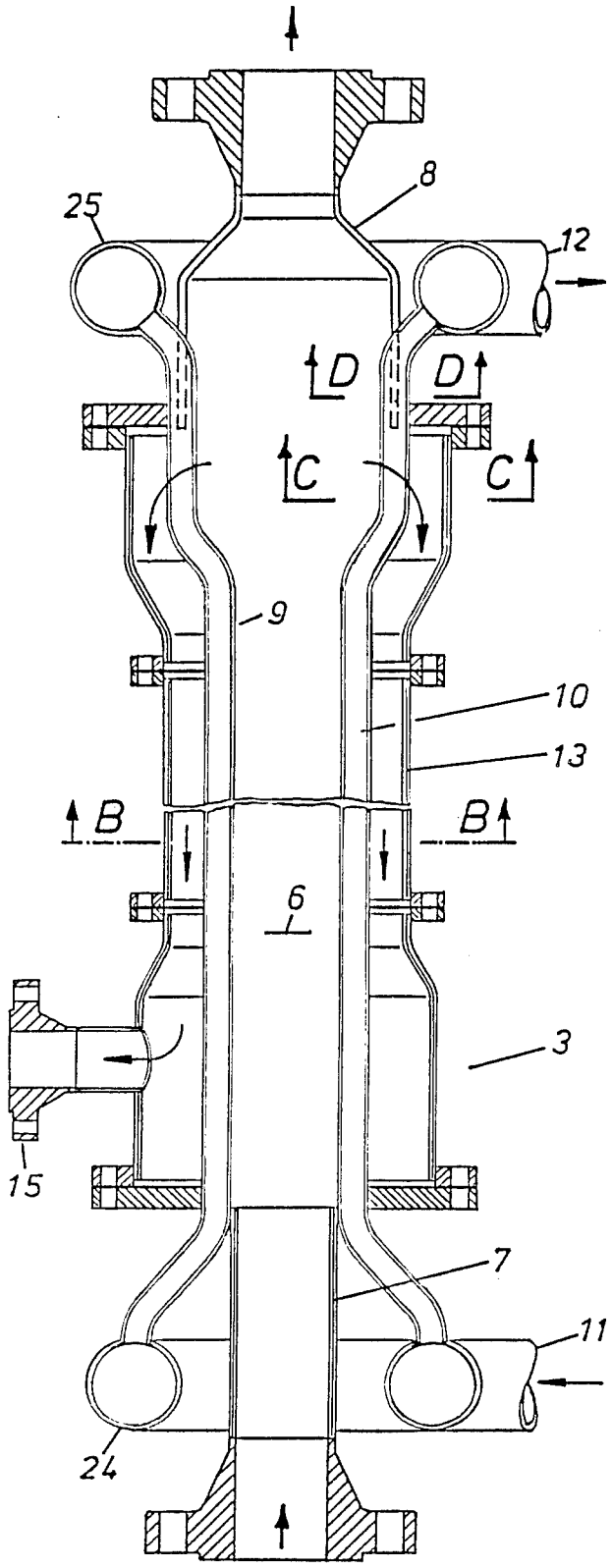
FIG. 3—Cross-sectional view through one of the two-stage heat exchanger devices of the system of FIG. 1.
Figure 6:
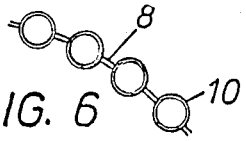
FIG. 6—Cross-sectional view taken along line D—D in FIG. 2.
Figure 5:
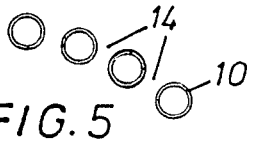
FIG. 5—Section C—C in FIG. 2
Figure 4:
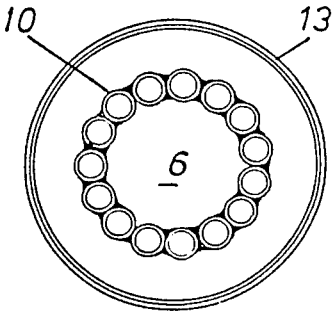
FIG. 4—Cross-sectional view taken along line B—B in FIG. 2.

With reference to FIGS. 1 and 2, in operation when heavy stock is used to charge the splitting furnace, the control valve 18 is opened and the control valve 19 is closed. The hot cracked gas from the splitting furnace is delivered via conduit 2 to the heat exchanger 3. Heat exchanger 3 comprises plural parallel connected two-stage heat exchanger devices which are individually connected to conduit 2 via pipelines 22 and the heat exchanger 7. The hot gases are cooled in the first stage of the heat exchanger and then may be delivered into the common collector 4 by means of the heat exchanger exits 8 and the pipelines 23. If necessary, further cooling is achieved through the injection of oil via injectors 5. The cooled gases are removed from the heat exchanger system through the pipeline 20. Referring to FIGS. 3–6, the individual pipes 10 which define the cooling jacket of the individual heat exchanger devices which comprise the heat exchanger 3 are interconnected at their lower ends via a coolant supply conduit 11 and at their upper ends by the exit or discharge conduit 12 which may be connected to a steam drum, not shown.

During operation with light charging stock, the control valve 18 is closed and the control valve 19 is open. The hot cracked gas exiting the splitting furnace via conduit 2 is delivered through the pipelines 22 and the exits 7 into the heat exchanger 3, is cooled in the first and second stages, and is sent to a second common collector 16 through the exits 15 for possible cooling by means of oil injectors 21 and withdrawal through the pipeline 20. The plurality of parallel pipes 10 which defines the cooling jacket of each of the individual heat exchanger devices are, as noted above, connected to a source of cooling water at their lower ends by the conduit 11. Pipes 10 are connected at their upper ends, by the conduit 12, with a steam drum (not pictured).

Continuing to refer to FIGS. 3, 4, 5 and 6, the hot gas passageway 6 of each two-stage heat exchanger device has an entry 7, an exit 8 and the cooling jacket. The cooling jacket 13 is comprised of the pipes 10 and an outer conduit 13. The entry 7 is connected to a cracked gas furnace such as common collector 4 of FIG. 1. The exit 8 is connected to a collector (not pictured). The jacket defining pipes 10 are mechanically joined to one another, to the entry 7, to the exit 8 and, via conduit 13, to the jacket second stage exit 15 in a gas-impermeable fashion.

The jacket pipes 10 are fluidically connected at their lower ends to the coolant supply conduit 11 via plenums 24 and, at their upper ends, are fluidically connected to the steam exit conduit 12 via plenums 25. In the upper portion of the jacket 13, the jacket pipes 10 are bent to the outside, in order to form openings 14 between pipes 10 for the passage of gas between the two stages of the heat exchanger devices. The jacket defining conduit 13 has an exit 15 for the second stage of the heat exchangers.

Figure 7:
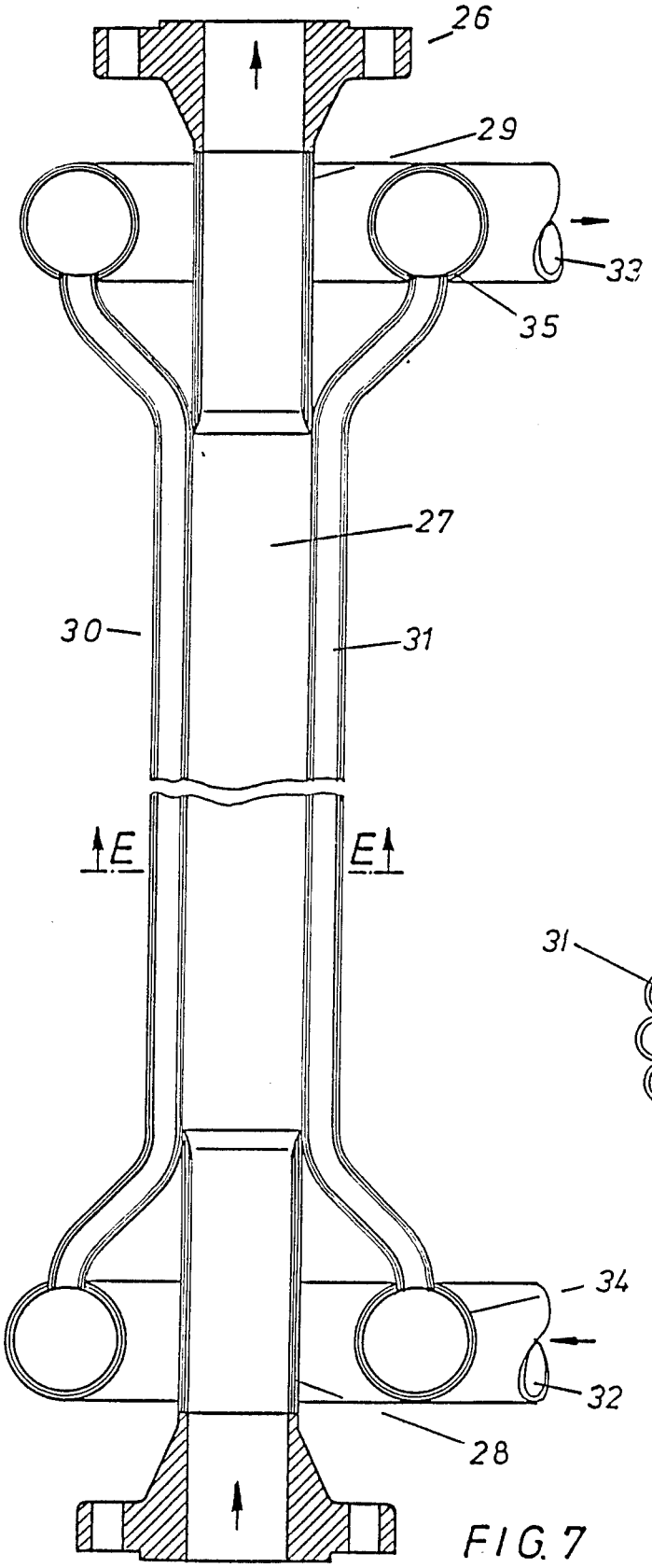
FIG. 7—Cross-sectional view through a single stage heat exchanger for use in the practice of the present invention.
Figure 8:
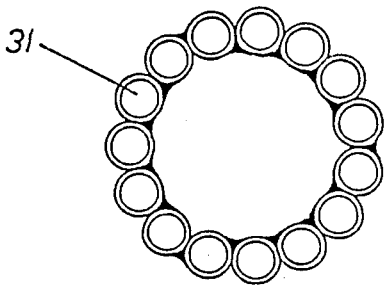
FIG. 8—Cross-sectional view taken along line E—E in FIG. 7.

The construction of a single-stage heat exchanger in accordance with the present invention is shown in FIGS. 7 and 8. This single-stage heat exchanger is differentiated from the two-stage heat exchanger described above by the fact that the jacket 13 and the openings 16 in the cooling jacket are omitted. Thus, in FIGS. 7 and 8, the pipes which define the hot gas passageway 27 are indicated at 31 and extend from a plenum 34, connected to the coolant supply conduit 32, to a plenum 35, connected to a steam line 33. The connectors 28 and 29 of the embodiment of FIGS. 7 and 8 correspond respectively to the entrance 7 and exit 8 of the FIG. 3 embodiment.

I claim:

1. Apparatus for the cooling of a hot process fluid comprising:

a plurality of heat exchanger means, each of said heat exchanger means comprising;

cooling jacket means for defining a central passageway for the flow of a fluid to be cooled, said cooling jacket means comprising a plurality of conduits arranged in side-by-side relationship to define said central passageway, said passageway having first and second ends and comprising a first stage of the heat exchanger means;

a second stage heat exchanger connected to and fluidically downstream of said heat exchanger means first stage, said second stage heat exchanger being in part defined by said cooling jacket means and having an inlet and an outlet, said inlet being coupled to said cooling jacket means defined central passageway, the process fluid flowing in a generally opposite direction in said second stage heat exchanger when compared to said heat exchanger means first stage;

means defining a fluid impermeable supply connector for the delivery of a heated fluid to the first end of said cooling jacket means defined central passageway; and means defining a fluid impermeable discharge connector for fluid passing through said central passageway, said discharge connector being coupled to the second end of said central passageway;

means for simultaneously delivering a hot process fluid to the supply connectors of said plurality of heat exchanger means whereby said hot process fluid will flow through said cooling jacket means defined passageways;

first common collector means for receiving cooled process fluid exiting the discharge connectors of said plural heat exchanger means, said first collector means including a first control valve located downstream, in the direction of fluid flow, from said heat exchanger means;

second common collector means, said second common collector means being connected to said second stage heat exchanger outlets and including a control valve located downstream, in the direction of fluid flow, from said heat exchanger means;

means for delivering a fluid coolant to said heat exchanger means cooling jacket means conduits at first ends thereof; and means for receiving coolant from said heat exchanger means cooling jacket means conduits at second ends thereof.

2. The apparatus of claim 1 further comprising means interconnecting said first and second common collector means downstream of said control valves, said interconnecting means including an exit for the cooled process fluid.

3. Apparatus of of claim 2 wherein said first and second stages of each of said heat exchanger means are interconnected via openings between said conduits, said openings being located adjacent said discharge connector means.

4. The apparatus of claim 3 further comprising oil injector means disposed in said interconnecting means.

* * * * *